United States Patent [19]

Tourlentes

[11] Patent Number: 5,032,437

[45] Date of Patent: Jul. 16, 1991

[54] JEWELRY AND METHODS FOR MAKING JEWELRY AND OTHER DECORATIVE DEVICES

[76] Inventor: Elizabeth A. Tourlentes, Valley View Rd., Box 251, R.R. 2, Galesburg, Ill. 61401

[21] Appl. No.: 392,265

[22] Filed: Aug. 10, 1989

[51] Int. Cl.[5] ..... A44C 7/00; A44C 27/00

[52] U.S. Cl. ..... 428/28; 29/160.6; 63/2; 63/12; 428/542.6; 428/906

[58] Field of Search ..... 446/488; 428/542.6, 428/7, 9, 12, 542.8, 906; 272/8 N; 63/2, 12; 29/160.6

[56] References Cited

U.S. PATENT DOCUMENTS

| | | | |
|---|---|---|---|
| 3,302,321 | 2/1967 | Walker | 446/488 |
| 3,706,173 | 12/1972 | Taylor | 428/122 X |
| 4,838,541 | 6/1989 | Stone | 428/906 X |
| 4,852,512 | 8/1989 | Klatt | 446/488 X |

*Primary Examiner*—Henry F. Epstein

*Attorney, Agent, or Firm*—Welsh & Katz, Ltd.

[57] ABSTRACT

Jewelry products and other decorative devices are made by rolling a piece of paper into a cylinder and cutting and bending the cylinder into a ladder having two round columns separated by a plurality of spaced, substantially transverse steps. The steps of the ladder are folded in an overlapping manner by pressing one column towards and above the other column so the first column is offset with respect to the second column. Both columns are then pressed flat towards the overlapping steps, and the entire device is coated with a flexible adhesive. After the adhesive drys, the device is cut to a desired shape and length, and the device is incorporated into a piece of jewelry or other decorative device such as a tree ornament, wall or window decoration, mobile or gift decoration. For example, an earring can be made by securing an eye hook to the device, and a barrette can be made by attaching a clasp to the device. A brooch can be made by securing two or more devices together with appropriate support structure.

17 Claims, 6 Drawing Sheets

JEWELRY AND METHODS FOR MAKING JEWELRY AND OTHER DECORATIVE DEVICES

This invention relates to decorative devices such as jewelry and methods for making decorative devices, and more particularly, to jewelry and other decorative devices made of paper products and methods of making decorative devices from paper products.

BACKGROUND OF THE INVENTION

Jewelry such as earrings, brooches, and barrettes, and other decorative devices such as tree ornaments, gift decorations, wall and window decorations and the like can be made in attractive designs with paper. The material costs for such decorative devices are low, and the devices are commercially feasible if labor costs are also low. However, intricate and detailed designs are labor intensive, so manufacturing costs increase as the designs become more complex. As a result, high manufacturing costs limit the designs available for commercial paper jewelry products and other decorative devices to relatively simple designs. Thus, there is a need for paper jewelry and methods for making paper jewelry and other decorative devices having designs which are relatively complex, yet relatively inexpensive to manufacture. There is also a need for such decorative devices to be structurally strong enough for normal use.

A paper ladder, sometimes called a "Jacob's ladder", is a novelty device made in several steps from a single piece of paper. However, a paper ladder is a novelty item which is not structurally sound and has little or no practical commercial value. Thus, there is also a need for methods and apparatus for creating useful objects from paper ladders.

Accordingly, one object of this invention is to provide new and improved jewelry and methods for making jewelry and other decorative devices.

Another object is to provide new and improved jewelry and other decorative devices made of paper products, and methods of making decorative devices from paper products.

Still another object is to provide new and improved paper jewelry and methods for making paper jewelry and other decorative devices having designs which are relatively complex, yet relatively inexpensive to manufacture and structurally strong enough for normal use.

Yet another object is to provide new and improved methods and apparatus for creating useful objects from paper ladders.

SUMMARY OF THE INVENTION

In keeping with one aspect of this invention, jewelry and other decorative devices such as tree ornaments, gift decorations and the like are made by rolling a flat rectangular piece of flexible material such as paper into a cylinder, and securing the outside axial edge to prevent the cylinder from unraveling. Two spaced radial slots are then cut over a portion of the cylinder to define a mid-section between two end sections, with the end sections and mid-section being joined by ribs formed where the slots are not cut. The two end sections are bent at the ribs until the end sections are substantially parallel to each other and perpendicular to the mid-section. The midsection is cut axially between the slots opposite the ribs, and is opened into a substantially flat strip having multiple layers. The top layer of the strip is pulled away from the end sections, allowing the inner turns of the cylinder to extend away from the outer turns in a concentric, overlapping relationship, forming a ladder having two cylindrical columns joined by a plurality of spaced steps.

The steps of the ladder are folded in a flat, overlapping manner by pressing one column toward and above the other column so the first column is offset with respect to the second column. Both columns are then pressed flat against the steps, and the entire device is coated with a flexible adhesive. After the adhesive drys, at least one end of the device is cut to a desired shape and length, and the device is used in making jewelry. An earring can be made by securing an eye hook to the device, or a brooch can be made by securing two or more devices together with appropriate support structure. A barrette can also be made by attaching an appropriate clasp to the device. Other decorative devices can be made in a similar fashion.

In an alternate embodiment, a single radial slot is made in the cylinder, so that the two columns are immediately adjacent each other. When the inner turns of the cylinder are extended, the resulting device can be combined with other similar modified devices to make brooches and other jewelry, as well as other decorative devices.

BRIEF DESCRIPTION OF THE DRAWINGS

The above-mentioned and other features of the invention and the manner of obtaining them will become more apparent, and the invention will be best understood by reference to the following description of an embodiment of the invention taken in conjunction with the accompanying drawings, in which.

DETAILED DESCRIPTION

Figure 1:
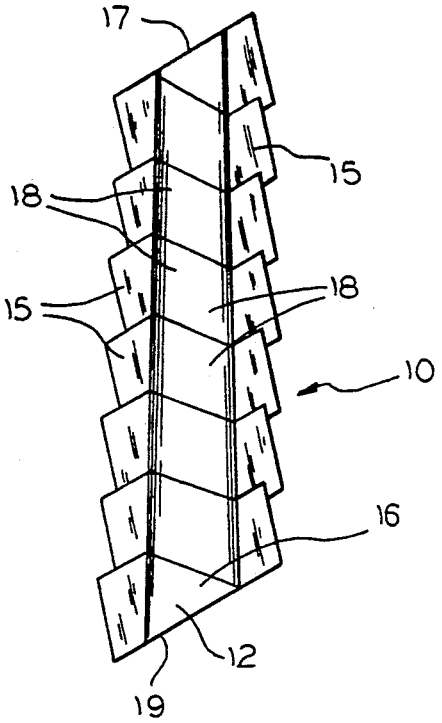
FIG. 1 is a front view of a device made in accordance with the principles of this invention.
Figure 2:
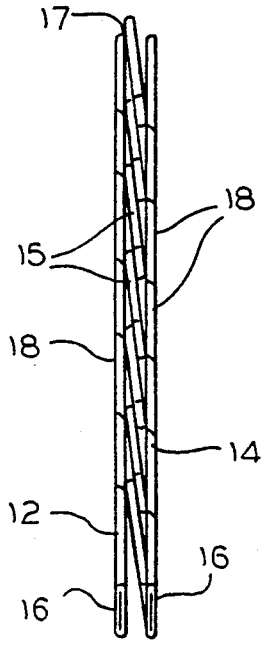
FIG. 2 is a side view of the apparatus of FIG. 1.
Figure 3:
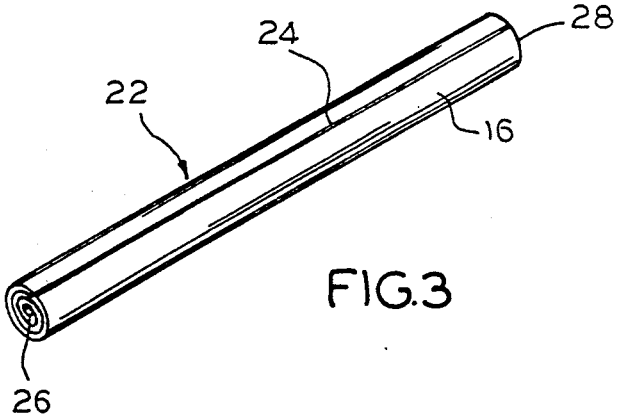
FIGS. 3–10 show various steps in the process of making the device of FIGS. 1 and 2.
Figure 4:
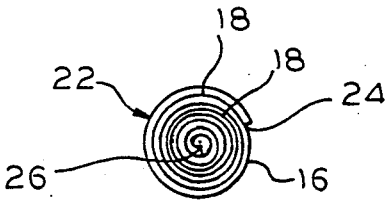

FIGS. 1 and 2 show a device 10 which can be used to make various types of jewelry, such as earrings, brooches and barrettes, in many creative, attractive designs. Other decorative devices, such as tree ornaments, wall and window decorations, mobiles and the like can also be made with the device 10. The device 10 is made of paper or other flexible material, and can include any desired color, combination of colors, or graphic designs, if desired. For example, colorful pages from magazines and pages from color comics have been used successfully in jewelry made in accordance with the principles of this invention.

The device 10 includes a first column 12, a second column 14, and a plurality of substantially flat overlapping pieces 15 joining the first column 12 to the second column 14. The columns 12, 14 are pressed substantially flat against the overlapping pieces, as seen in FIG. 2.

Each of the columns 12, 14 has a plurality of continuous concentric turns including an outer turn 16 and a plurality of inner turns 18, with each turn being partially inside the adjoining turn. The overlapping pieces 15 join turns of the column 12 to respective turns of the column 14.

The columns 12, 14 and pieces 15 are cut to any suitable design, such as the angle cuts shown on ends 17 and 19, and a flexible adhesive is applied to the device 10 to secure the columns and adjoining pieces in the desired manner. The adhesive used to make the device 10 and other devices described here is preferably a flexible adhesive such as "Mod Podge" Gloss-Lustre water-base adhesive, by Plaid Enterprises, Inc., Norcross, Ga. 30091-7600. A suitable flexible adhesive has good bonding ability, but does not make the paper substrate excessively brittle and susceptible to cracking or breaking in normal use.

The process used to make the device 10 is shown in FIGS. 3 through 10. A rectangular or square piece of flexible material (FIG. 3) such as paper or the like is rolled into a cylinder 22 having an exposed axial edge 24 and two opposed ends 26, 28. The exposed edge 24 is secured to the outer turn 16 with tape or any suitable adhesive to prevent the cylinder 22 from unravelling. The cylinder 22 includes the outer turn 16 and a plurality of inner turns 18.

Two spaced radial slots 30, 32 (FIG. 5) are cut in the cylinder 22 between the ends 26, 28 over a portion of perhaps about 180 degrees to 315 degrees of the outer turn 16. The slots 30, 32 define a mid-section 36 between two end sections 38, 40 which are joined by ribs 42, 44. The ribs 42, 44 are formed where the slots 30, 32 are not cut.

Figure 6:
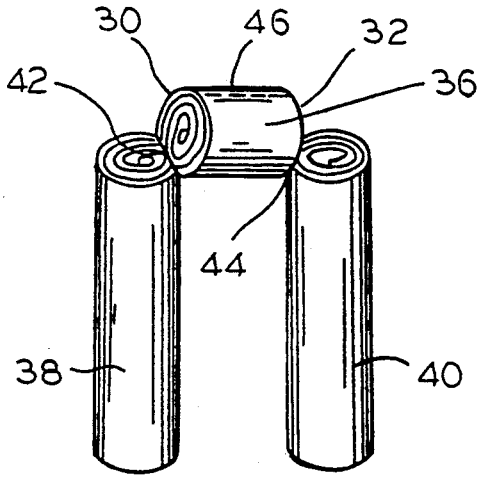
Figure 7:
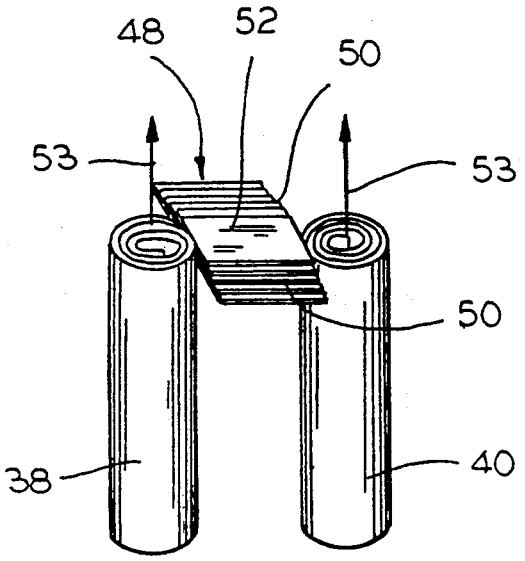

The two end sections 38, 40 are bent at the ribs 42, 44 until the end sections 38, 40 are substantially parallel to each other, and are perpendicular to the mid-section 36, as seen in FIG. 6. The mid-section 36 is then cut axially along line 46 from slot 30 to slot 32, opposite the ribs 42, 44. The mid-section 36 is opened into a strip 48 having multiple layers 50 (FIG. 7), and the top layer 52 of the strip 48 is moved away from the end sections 38, 40 in the manner indicated by arrows 53. As the top layer 52 is moved in this manner, the inner turns 18 of the end sections 38, 40 extend away from the outer turn 16, forming a ladder 54 (FIGS. 8 and 9) having the cylindrical columns 12, 14 joined by the plurality of pieces 15, which are spaced apart substantially parallel to each other and are not yet overlapping.

Figure 8:
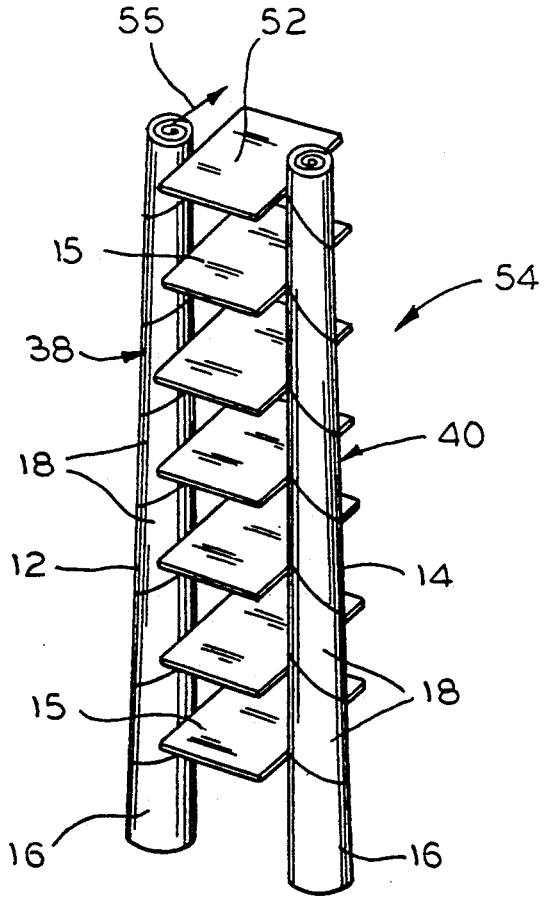
Figure 9:
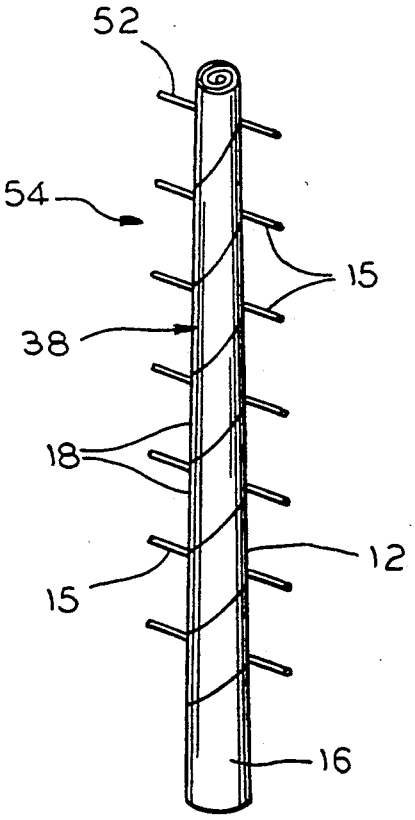
Figure 10:
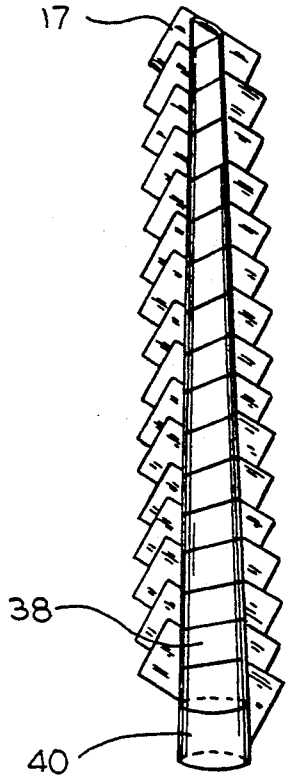
Figure 11:
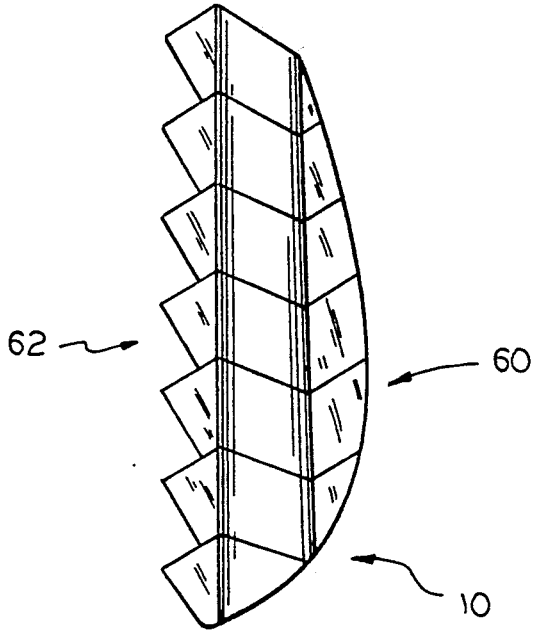
FIG. 11 is a front view of an alternate embodiment of the device of FIG. 1.

The columns 12, 14 of the ladder 54 are pressed together by pushing the end section 38 up and towards the end section 40, as shown by arrow 55 in FIG. 8, causing the pieces 15 to turn and overlap without being crushed. The end sections 38, 40 are pressed substantially flat against the overlapping pieces 15, as seen in FIGS. 1 and 2 and the device lo is coated with a flexible adhesive which is permitted to dry. The ends 17, 19 of the device 10 are cut as desired (see FIGS. 1 and 10), to create any one of a variety of designs, such as those shown in FIGS. 1 and 11. In addition, the sides of the device 10 can be trimmed and cut as desired, as shown on side 60 of the device 10 in FIG. 11, or left intact, as on side 62 in FIG. 11.

Figure 12:
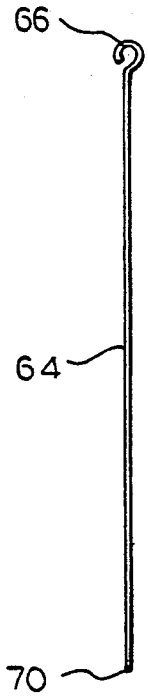
FIG. 12 is a view of an eye pin used with the device of FIG. 1.
Figure 13:
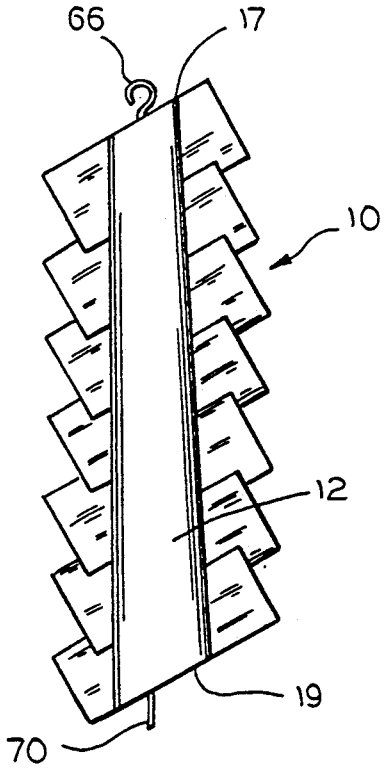
FIG. 13 is a front view of the device of FIG. 1, with the eye pin of FIG. 12 placed in the device.
Figure 15:
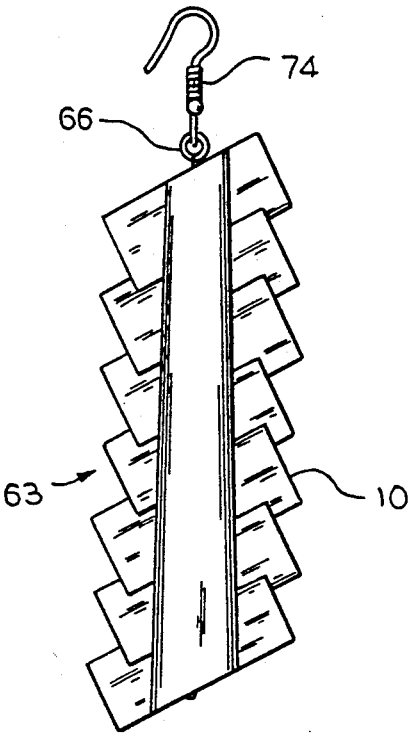
FIG. 15 is a front view of an earring made with the device of FIG. 1.

The finished device 10 can be used to make a variety of types of jewelry, including the earring 63 shown in FIG. 15 An eye pin 64 (FIG. 12) is inserted through the column 12 (FIG. 13) (or the column 14) in the manner shown in FIG. 13, with a round end 66 extending just above the top end 17 and a straight end 70 extending past the bottom end 19.

Figure 14:
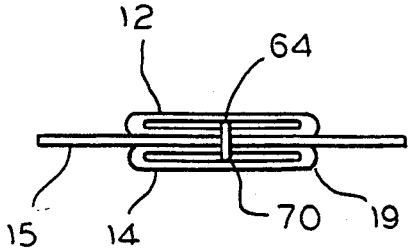
FIG. 14 is an end view of the device of FIG. 13, with the eye pin fully installed.

The straight end 70 is bent around the bottom end 19 and into the column 14 to secure the eye pin 64 (FIG 14). The end 70 can be crimped, if desired, to further secure the pin. The eye pin 64 can then be further secured with adhesive if desired, and an ear wire 74 (or an ear pin) is attached to the round end 66, as shown in FIG. 15, to complete the earring.

Figure 16:
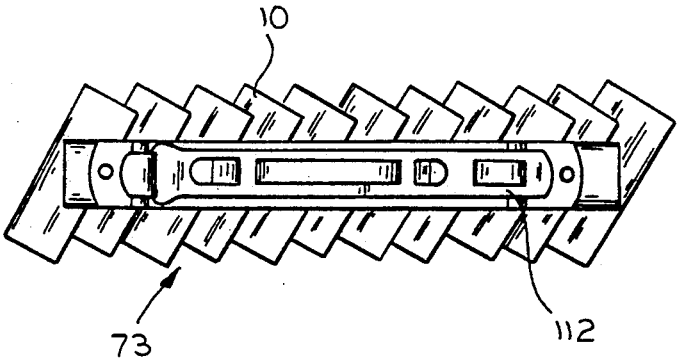
FIG. 16 is a back view of a barrette made with the device of FIG. 1.

A barrette 73 could also be made with the device 10 by securing a clasp 112 to it, as shown in FIG. 16. The clasp 112 could also be replaced with a pin bar to make a brooch.

Figure 17:
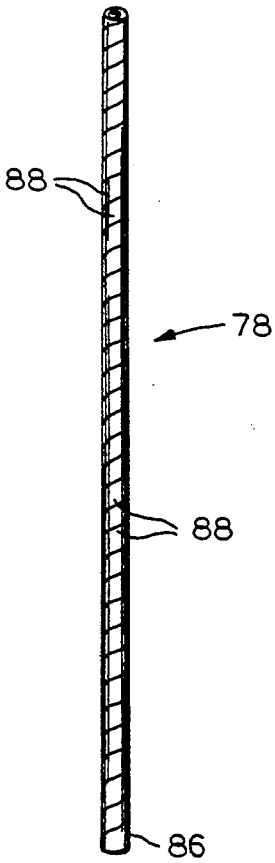
FIG. 17 is a front view of a straight decorative paper tube made in accordance with the principles of the invention.

A tube 78 (FIG. 17) can be used to make jewelry, with or without the device 10, as will be seen. The tube 78 is made of a single piece of paper or other flexible material which is rolled into a cylinder and extended so that an outer turn 86, and a plurality of concentric inner turns 88, partially overlap each other.

Figure 19:
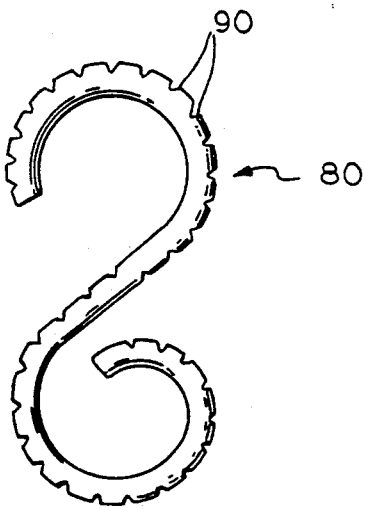
FIGS. 18 and 19 show various steps in the process of making a curled paper tube from the straight tube of FIG. 18.
Figure 18:
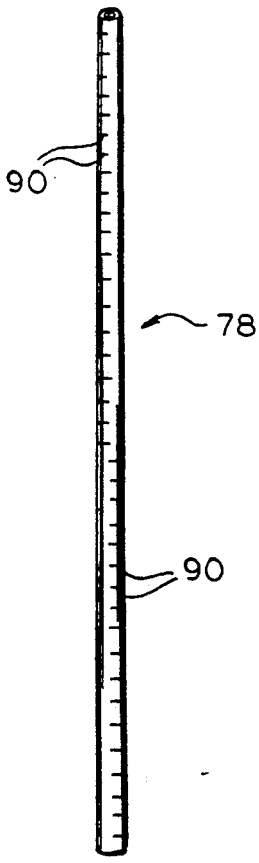
Figure 20:
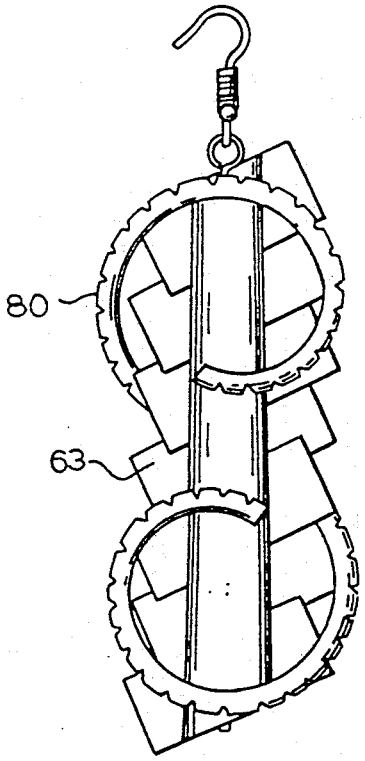
FIG. 20 is a front view of the earring of FIG. 15, with a decorative paper tube of FIG. 19 attached.
Figure 21:
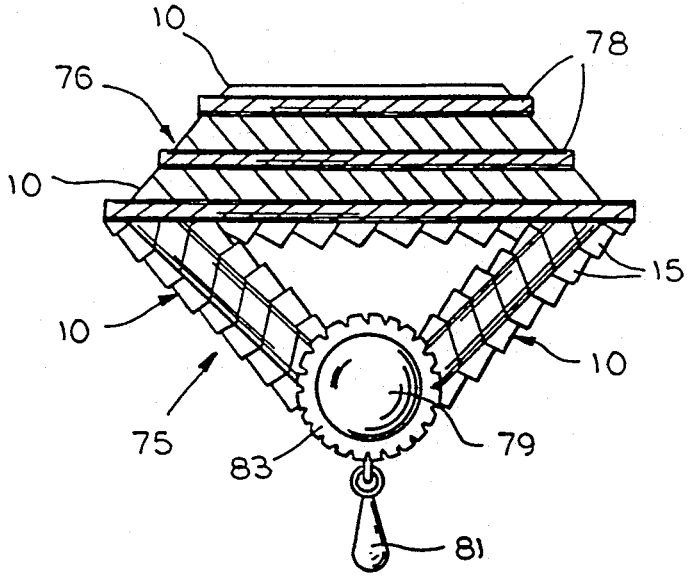
FIG. 21 is a front view of a pin made of two of the devices of FIG. 1.

A plurality of slices 90 can be made in the tube 78, as shown in FIG. 18, and the tube 78 bent in any suitable manner, such as the curved tube 80 shown in FIG. 19, or the circular tube 83 shown in FIG. 21. The tube can be pressed flat during this process. The earring 63 in FIG. 15 is shown decorated with a curved tube 80 in FIG. 20.

Figure 22:
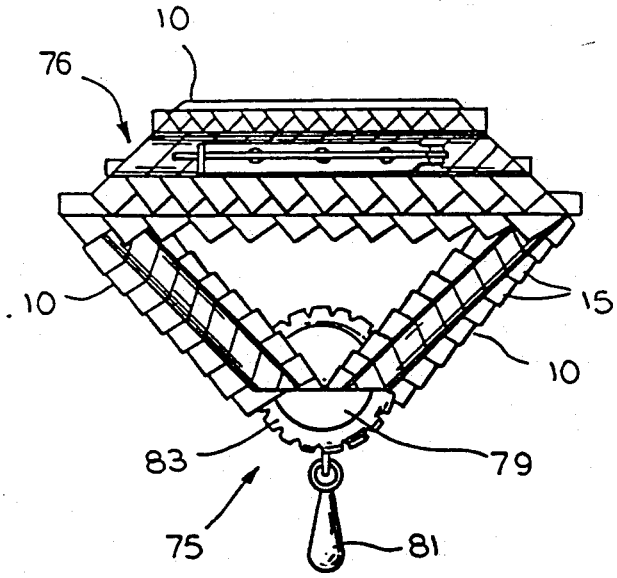
FIG. 22 is a back view of the device of FIG. 21.

The slices 90 are located so that they are on the outside circumference of the tube when the finished shape is made. Flexible adhesive is used to maintain the desired shape of the tubes 78, 80 and 83, either before or after they are placed on the selected piece of jewelry Two devices 10 can be combined to make a brooch 75, as seen in FIGS. 21 and 22. The devices 10 are secured to each other at one end, and are secured at the other end by a cross member 76, which can be one or more devices 10 trimmed as desired The devices 10 can be oriented so that the pieces 15 are at an angle with respect to the cross member 76, or the pieces 15 can be oriented parallel to the member 76. A pin bar 85 (FIG. 22) is secured to the brooch 75 for attachment to clothing One or more straight tubes 78 (FIG. 19), a button 79, a tassel 81 and the circular tube 83 can be added as desired.

Figure 23:
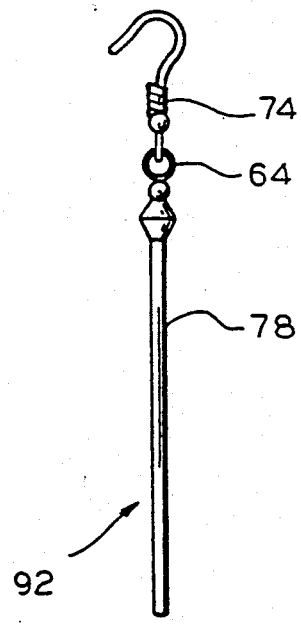
FIG. 23 is a front view of an earring made from the tube of FIG. 17.

The tubes 78, 80 and 83 can also be used to make interesting, creative jewelry designs without the device 10. As seen in FIG. 23, an earring 92 includes a straight tube 78, trimmed as desired, an eye pin 64 and an ear wire 74. The curved tube 80 and the circular tube 83 could also be used to make earrings and other jewelry.

Figure 5:
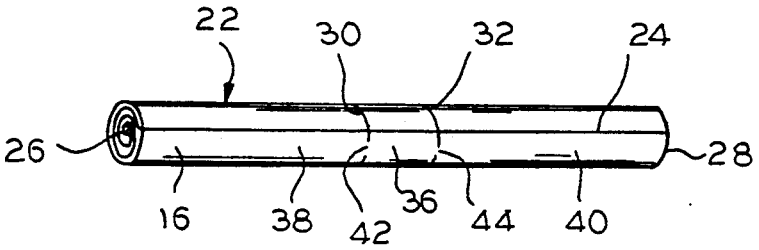
Figure 24:
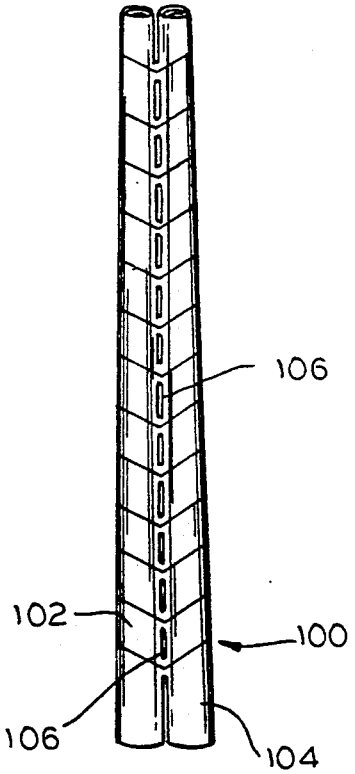
FIG. 24 is an alternate embodiment of the device of FIG. 1.

A modification of the device 10 can produce yet additional jewelry designs. FIG. 24 shows a device 100 having two columns 102, 104 joined together by pieces 106. The device 100 is similar to the device 10, except that the slots 30, 32 in FIG. 5 are replaced by a single slot, bringing the columns 102, 104 close together.

Figure 25:
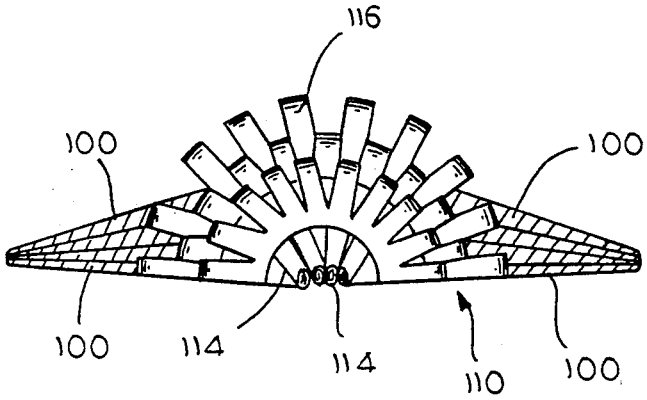
FIG. 25 is a front view of a barrette which includes several of the devices of FIG. 24.
Figure 26:
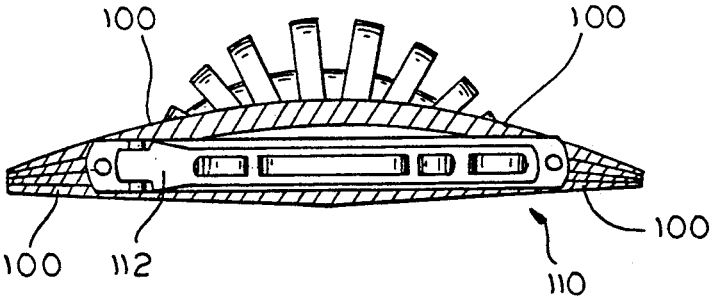
FIG. 26 is a back view of the barrette of FIG. 25.

Several devices 100 can be trimmed and assembled to make jewelry such as the barrette 110 shown in FIGS. 25 and 26. The barrette 110 includes a plurality of devices 100 and a clasp 112, secured together with adhesive Straight tubes 114, semi-circular tubes 116 and other pieces can also be secured to the device 100 in any desired manner.

The many advantages of this invention are now apparent. Jewelry and other decorative devices can be made from paper products which have relatively complex designs, yet are relatively inexpensive to manufacture. Moreover, the designs have sufficient structural strength for normal use.

While the principles of the invention have been described above in connection with specific apparatus and applications, it is to be understood that this description is made only by way of example and not as a limitation on the scope of the invention. For example, it is apparent that the invention could be used to make many types of decorative devices, in addition to jewelry.

What is claimed is:

1. A method for making a decorative device comprising the steps of rolling a flat rectangular piece of flexible material into a cylinder, the axially extending outside edge of said material being exposed;

securing said exposed edge to prevent said cylinder from unraveling;

cutting two spaced radial slots over a portion of said cylinder to define a mid-section between two end sections, said end sections and said mid-section being joined by ribs formed where said slots are not cut;

bending said two end sections at said ribs until said end sections are substantially parallel to each other and perpendicular to said mid-section;

cutting said mid-section axially between said slots opposite said ribs, and opening said mid-section into a strip having multiple layers;

moving the top layer of said strip away from said end sections, allowing the inner turns in said end sections to extend away from the outer turns, forming a ladder having two cylindrical columns joined by a plurality of spaced substantially transverse pieces;

pressing said columns together to fold said pieces in a flat overlapping manner;

pressing both of said columns towards said overlapping pieces, flattening said columns;

coating the device with a flexible adhesive; and cutting at least one end of the device to a desired shape and length.

2. The method of claim 1 further comprising the steps of inserting an eye pin axially through the center opening in a selected column, said eye pin having hook means at one end, the other end being substantially straight;

bending said straight end of said eye pin so that a portion of said straight end can be inserted into the adjacent column;

applying adhesive to at least a portion of said eye pin to secure said eye pin; and securing attachment means to said hook means in said eye pin.

3. The method of claim 1 comprising the step of securing clasp means to the device.

4. The method of claim 1 comprising the step of securing pin attachment means to the device.

5. A decorative device made by the process of:

rolling a flat rectangular piece of flexible material into a cylinder, the axially extending outside edge of said material being exposed;

securing said exposed edge to prevent said material from unravelling;

cutting two spaced radial slots over a portion of said cylinder to define a mid-section between two end sections, said end sections and said mid-section being joined by ribs formed where said slots are not cut;

bending said two end sections at said ribs until said end sections are substantially parallel to each other and perpendicular to said mid-section;

cutting said mid-section axially between said slots opposite said ribs, and opening said mid-section into a strip having multiple layers;

moving the top layer of said strip away from said end sections, allowing the inner turns in said end sections to extend away from said outer turns, forming a ladder having two cylindrical columns joined by a plurality of spaced substantially transverse pieces;

pressing said columns together. to fold said pieces in a flat overlapping manner;

pressing both of said columns towards said overlapping pieces, flattening said columns;

coating the device with a flexible adhesive; and cutting at least one end of the device to a desired shape and length.

6. The device of claim 5, the process further comprising:

inserting an eye pin axially through the center opening in a selected column, said eye pin having hook means at one end, the other end being substantially straight;

bending said straight end of said eye pin so that a portion of said straight end can be inserted into the adjacent column;

applying adhesive to at least a portion of said eye pin to secure said eye pin; and securing attachment means to said hook means in said eye pin.

7. The device of claim 5, the process further comprising securing clasp means to the device.

8. The device of claim 5, the process further comprising securing pin attachment means to the device.

9. A decorative device comprising:

a first column of flexible material having a plurality of partially overlapping turns in a flattened condition;

a second column of flexible material having a plurality of partially overlapping turns in a flattened condition;

a plurality of flat overlapping pieces between said first column and said second column; and adhesive means for securing said columns and adjoining pieces to each other in a desired manner.

10. A decorative device comprising a tube made from a single piece of flexible material, said tube having an outer turn and a plurality of concentric inner turns which overlap each other, means for securing said outer turn to the next adjacent inner turn to prevent said tube from unraveling, a plurality of slices in said tube, said tube being secured in said desired shape such that said slices are on the outside periphery of said tube when said tube is secured in said shape, and adhesive means for securing said turns of said tube in a desired manner.

11. The device of claim 10 further comprising an eye pin secured to said tube, and attachment means secured to said eye pin.

12. A method for making a decorative device comprising the steps of rolling a flat rectangular piece of flexible material into a cylinder, the axially extending outside edge of said material being exposed;

securing said exposed edge to prevent said cylinder from unraveling;

cutting a single spaced radial slot over a portion of said cylinder to define two end sections, said end sections being joined by a rib formed where said slot is not cut;

bending said two end sections at said rib until said end sections are substantially parallel to each other, said rib having a plurality of layers including a top layer;

moving the top layer of said rib away from said end sections, allowing the inner turns in said end sections to extend away from the outer turns, forming two cylindrical substantially adjacent columns joined by a plurality of spaced pieces;

coating the device with a flexible adhesive; and cutting at least one end of the device to a desired shape and length.

13. A decorative device made by the process of:

rolling a flat rectangular piece of flexible material into a cylinder, the axially extending outside edge of said material being exposed;

securing said exposed edge to prevent said cylinder from unravelling;

cutting a single spaced radial slot over a portion of said cylinder to define two end sections, said end sections being joined by a rib formed where said slot is not cut;

bending said two end sections at said rib until said end sections are substantially parallel to each other, said rib having a plurality of layers including a top layer;

moving the top layer of said rib away from said end sections, allowing the inner turns in said end sections to extend away from said outer turns, forming two cylindrical substantially adjacent columns joined by a plurality of spaced pieces;

coating the device with a flexible adhesive; and cutting at least one end of the device to a desired shape and length.

14. A method for making a decorative device comprising the steps of :

rolling a flat rectangular piece of flexible material into a cylinder, the axially extending outside edge of said material being exposed;

securing said exposed edge to prevent said cylinder from unraveling;

cutting two spaced radial slots over a portion of said cylinder to define a mid-section between two end sections, said end sections and said mid-section being joined by ribs formed where said slots are not cut;

bending said two end sections at said ribs until said end sections are substantially parallel to each other and perpendicular to said mid-section;

cutting said mid-section axially between said slots said ribs, and opening said mid-section into a strip having multiple layers;

moving the top layer of said strip away from said end sections, allowing the inner turns in said end sections to extend away from the outer turns, forming a ladder having two cylindrical columns joined by a plurality of spaced substantially traverse pieces;

coating the device with a flexible adhesive; and cutting at least one end of the device to a desired shape and length.

15. A decorative device made by the process of:

rolling a flat rectangular piece of flexible material into a cylinder, the axially extending outside edge of said material being exposed;

securing said exposed edge to prevent said material from unravelling;

cutting two spaced radial slots over a portion of said cylinder to define a mid-section between two end sections, said end sections and said mid-section being joined by rinds formed where said slots are to cut;

bending said two end sections at said ribs until said end sections are substantially parallel to each other and perpendicular to said mid-section;

cutting said mid-section axially between said slots opposite said ribs, and opening said mid-section into a strip having multiple layers;

moving the top layer of said strip away from said end sections, allowing the inner turns in said end sections to extend away from said outer turns, forming a ladder having two cylindrical columns joined by a plurality of spaced substantially transverse pieces;

coating the device with a flexible adhesive; and cutting at least one end of the device to a desired shape and length.

16. The device of claim 6 wherein the device comprises an earring.

17. The device of claim 16 wherein said flexible material is paper.

* * * * *

UNITED STATES PATENT AND TRADEMARK OFFICE

CERTIFICATE OF CORRECTION

PATENT NO. : 5,032,437

DATED : July 16, 1991

INVENTOR(S) : Elizabeth A. Tourlentes

It is certified that error appears in the above-identified patent and that said Letters Patent is hereby corrected as shown below:

Column 3, line 32, after "Podge" insert --\--.

Column 4, line 7, change "1o" to --10--.
line 7, after "2" insert --,-- (a comma).

Column 4, lines 59 and 60, after "clothing" insert --.--.

Column 8, line 18, after "slots" insert --opposite--.

Column 8, line 38, change "rinds" to --ribs--.

Column 8, line 38, change "to" to --not--.

Signed and Sealed this

Thirtieth Day of March, 1993

*Attest:*

STEPHEN G. KUNIN

*Attesting Officer*

*Acting Commissioner of Patents and Trademarks*